US006381761B2

(12) United States Patent
Kawashima et al.

(10) Patent No.: US 6,381,761 B2
(45) Date of Patent: May 7, 2002

(54) FACE MASK FOR DIVING

(75) Inventors: Haruo Kawashima; Taro Fujima, both of Tokyo (JP)

(73) Assignee: Tabata Co., Ltd (JP)

( * ) Notice: Subject to any disclaimer, the term of this patent is extended or adjusted under 35 U.S.C. 154(b) by 0 days.

(21) Appl. No.: 09/785,912

(22) Filed: Feb. 16, 2001

(30) Foreign Application Priority Data

Feb. 17, 2000 (JP) ..... 12-040131

(51) Int. Cl.[7] ..... A61F 9/02
(52) U.S. Cl. ..... 2/428
(58) Field of Search ..... 2/428, 430, 441–443

(56) References Cited

U.S. PATENT DOCUMENTS 5,329,643 A * 7/1994 Sato ..... 2/428
5,479,917 A * 1/1996 Hsieh ..... 128/200.29

* cited by examiner

*Primary Examiner*—John J. Calvert
*Assistant Examiner*—Katherine Moran
(74) *Attorney, Agent, or Firm*—Baker & Daniels

(57) ABSTRACT

A face mask for diving includes a pair of front lenses and a nose cover formed by a portion of a skirt between these lenses. Proximal ends of the nose cover and a portion of the skirt being contiguous to these proximal ends are curved along the lens frame with the lenses held therein closely in contact with an inner peripheral surface and an inner surface of the lens frame.

1 Claim, 5 Drawing Sheets

FACE MASK FOR DIVING

BACKGROUND OF THE INVENTION

This invention relates to a face mask for diving.

FIG. 4 is a perspective view showing a face mask 101 for diving of prior art and FIG. 5 is a sectional view taken along line V—V in FIG. 4. In FIG. 5, chain lines indicate contours H of a diver wearing the mask 101. The mask 101 comprises a pair of front lenses 102, a lens frame 103 having the lenses 102 held therein, a skirt 104 extending rearward from peripheries of the lenses 102 and a head band 105 extending rearward from laterally opposite ends of the lens frame 103. The skirt 104 is made of flexible elastic material and defines between the pair of lenses 102 a nose cover 106 projecting forward. The nose cover 106 has a pair of side walls 107 lying on both sides of a mask wearer's nose and a bottom wall 108 underlying the wearer's nares. The side walls 107 are dimensioned to be sufficiently high so that proximal ends 109 thereof come in contact with the mask wearer's face. A portion 111 of the skirt 104 contiguous to the proximal ends 109 is curved in V-shape and extends to the lenses 102. To some degree, the nose cover 106 configured in this manner solves a problem such that the nose cover 106 is collapsed or remarkably deformed under a water pressure in the midst of diving.

However, the higher the side walls 107 the lower the rigidity of the nose cover 106 so far as the nose cover 106 also is made of flexible elastic material. In consequence, the nose cover in the face mask for diving as has been described above is still apt to be deformed under a water pressure.

SUMMARY OF THE INVENTION

It is an object of this invention to provide a face mask for diving designed so that its nose cover is effectively protected from being readily deformed.

According to this invention, there is provided a face mask for diving comprising a pair of front lenses, a lens frame adapted to hold the lenses and a head band extending rearward from laterally opposite ends of the lens frame so as to form a loop, wherein the lenses are surrounded by a pair of annular portions defined by the lens frame, respectively, the annular portions intersecting each other along upper edges thereof and extending downward from this intersecting point so as to describe a substantially inverted V-shape between the lenses and wherein the skirt defines, in this V-shaped region defined by the lens frame, a nose cover projecting forwardly of the mask.

The face mask further comprises the nose cover having a pair of side walls lying on both sides of the mask wearer's nose and a bottom wall underlying the nares of the mask wearer, the lens frame having inner and outer peripheral surfaces at least inside and outside the annular portions and inner surface and an inner surface extending between the inner and outer peripheral surfaces and confronting the face of the mask wearer and a portion of the skirt which is contiguous to respective proximal ends of the side walls being curved along the annular portions of the lens frame closely in contact with the inner peripheral surface and the inner surface.

DETAILED DESCRIPTION OF THE PREFERRED EMBODIMENTS

Details of a face mask for diver according to this invention will be more understood from the description given hereunder with reference to the accompanying drawings.

Figure 1:
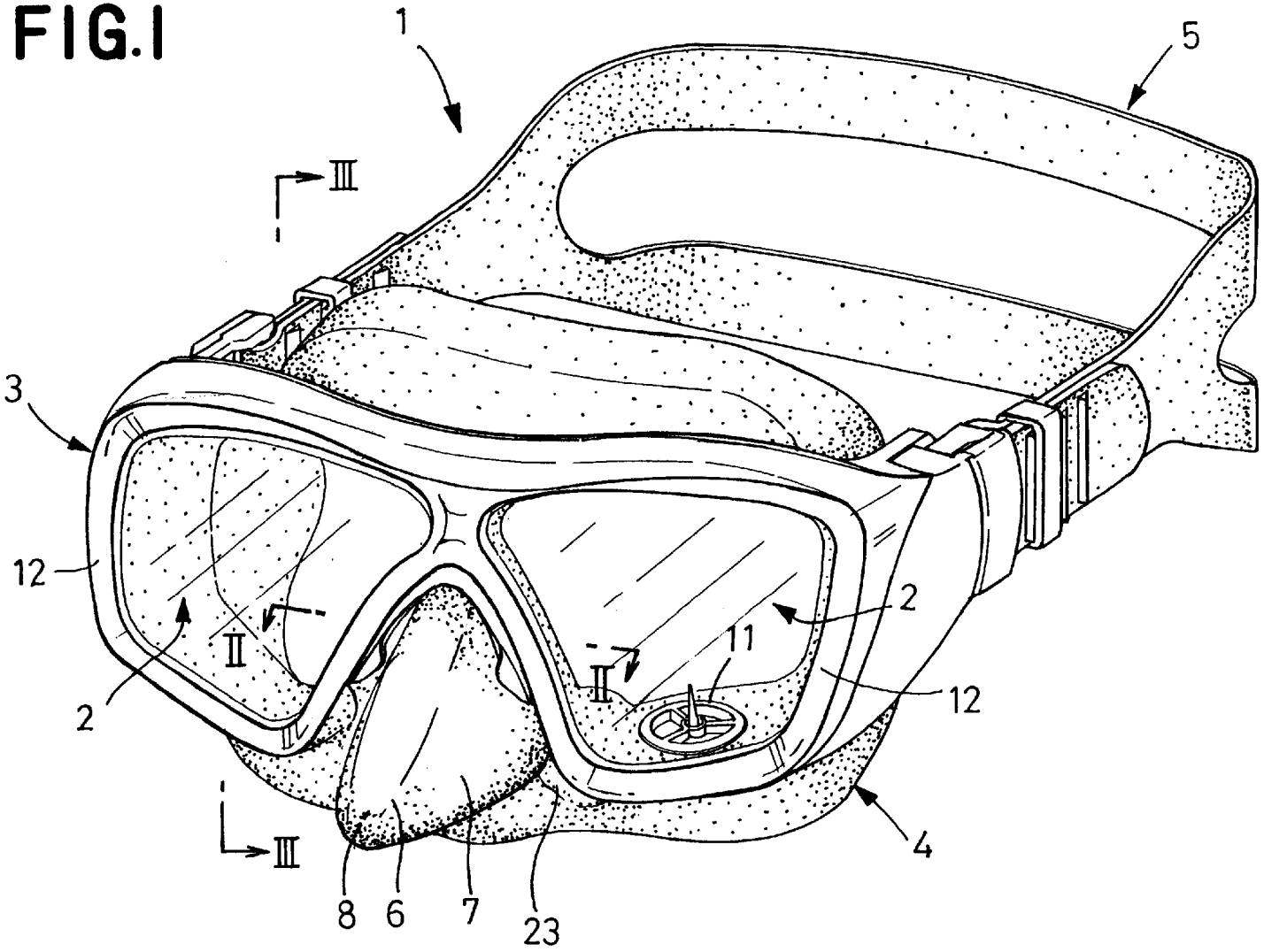
FIG. 1 is a perspective view showing a face mask constructed in accordance with a principle of this invention.

A face mask for diving shown by FIG. 1 in a perspective view comprises a pair of front lenses 2, a lens frame 3 having a pair of annular portions 12 adapted to hold the respective lenses 2, a skirt 4 extending rearward from peripheries of the respective lenses 2 and a head band 5 extending rearward from laterally opposite ends of the lens frame 3 so as to form a loop. The skirt 4 made of flexibly elastic material includes a nose cover 6 projecting forward from between the pair of lenses 2 and a non-return valve 11 provided behind the lens 2 for the mask wearer's left eye. When an amount of water has been collected inside the respective lenses 2 to a certain level after the mask 1 was put on the wearer's head, the non-return valve 11 may be forcibly opened by breathing discharged from the wearer's nose to expel the collected amount of water out. The nose cover 6 has transversely opposite side walls 7 lying on both sides of the wearer's nose and a bottom wall 8 underlying the wearer's nares. The respective lenses 2 are held by the respective annular portions 12 of the frame 3. The respective annular portions 12 are integrally connected along their upper edges and, between the lenses 2, these annular portions 12 extending obliquely downward so as to describe a substantially inverted V-shape.

Figure 2:
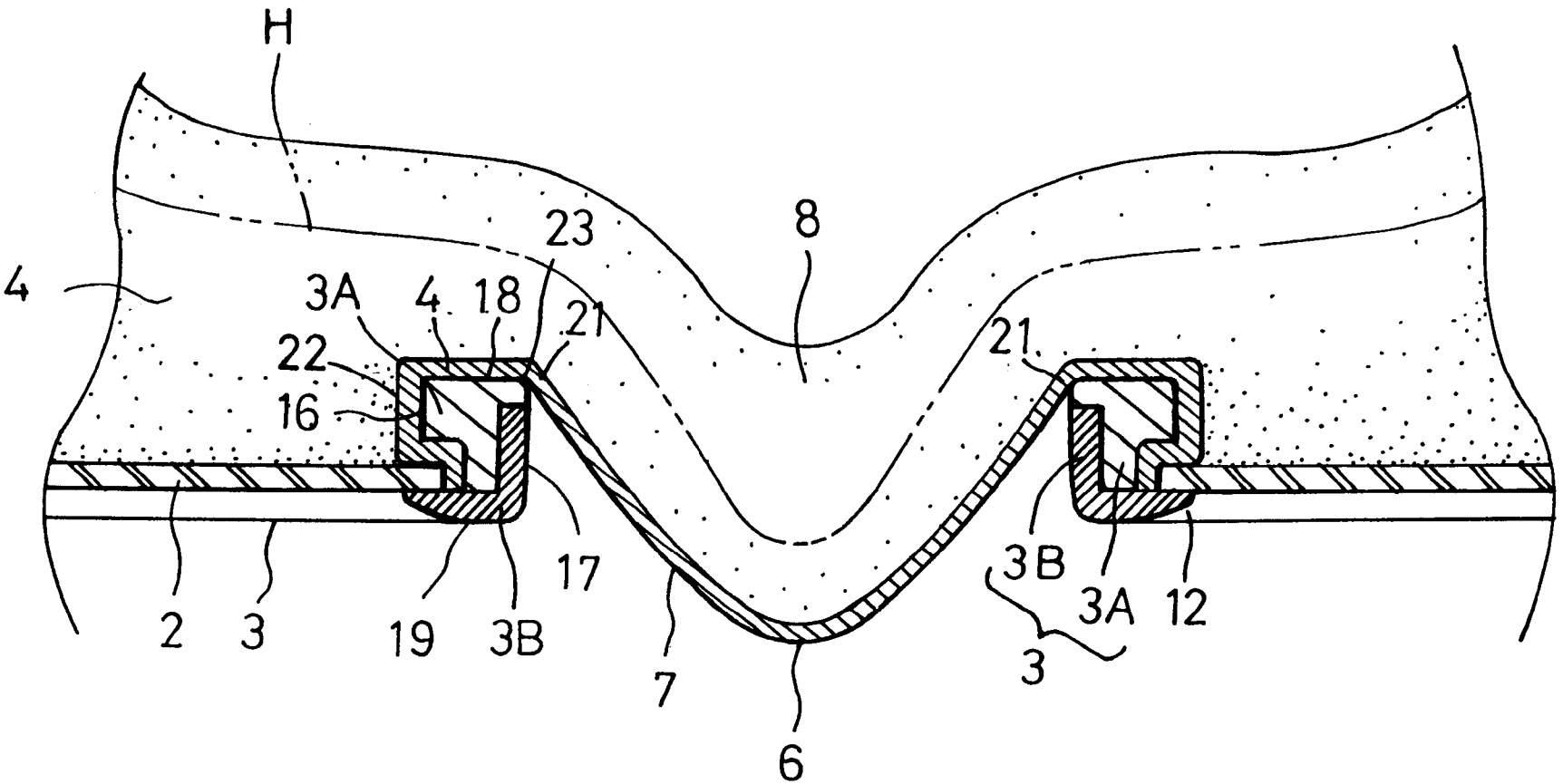
FIG. 2 is a sectional view taken along line II—II in FIG. 1.
Figure 3:
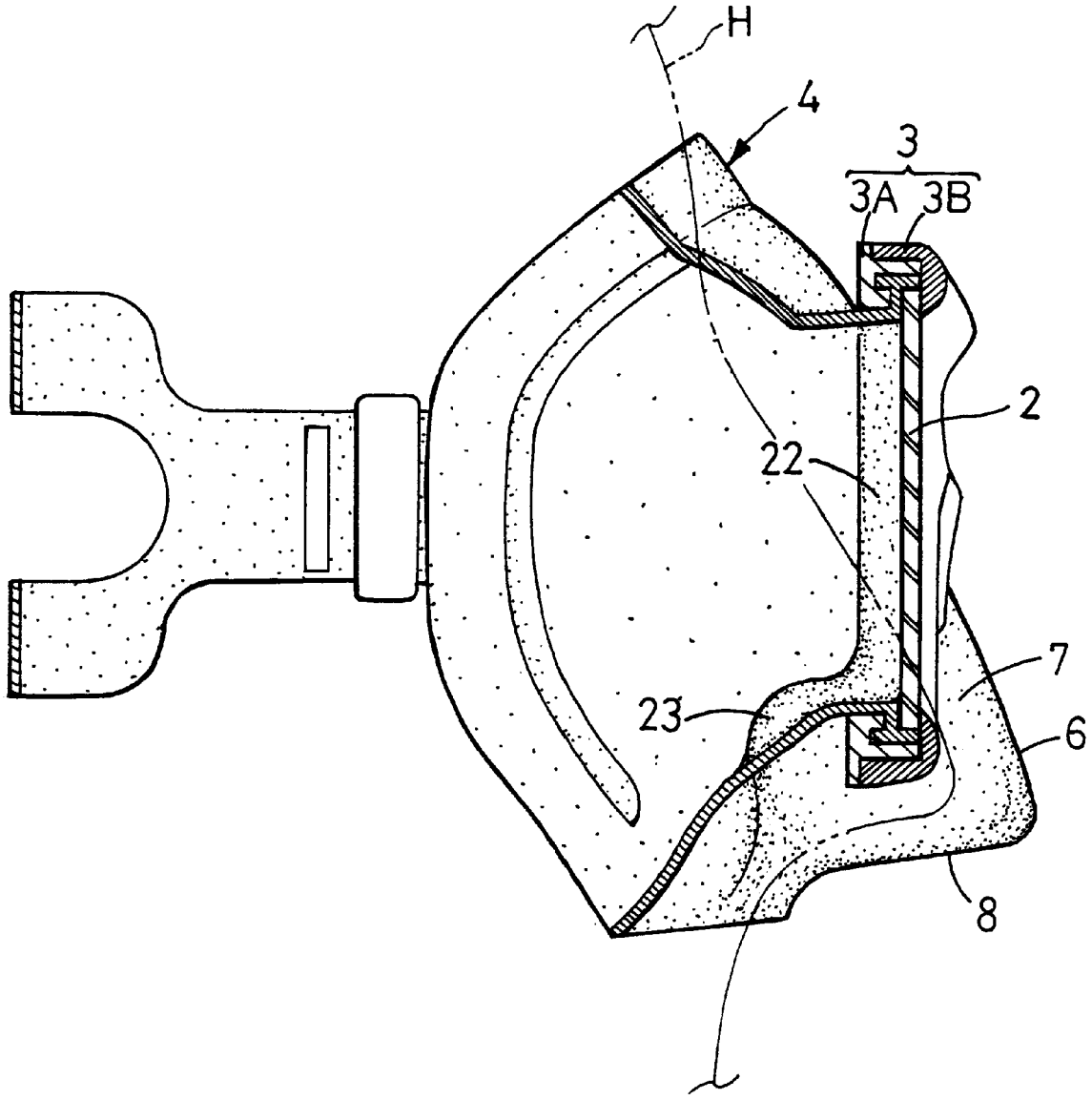
FIG. 3 is a sectional view taken along line III—III in FIG. 1.
Figure 4:
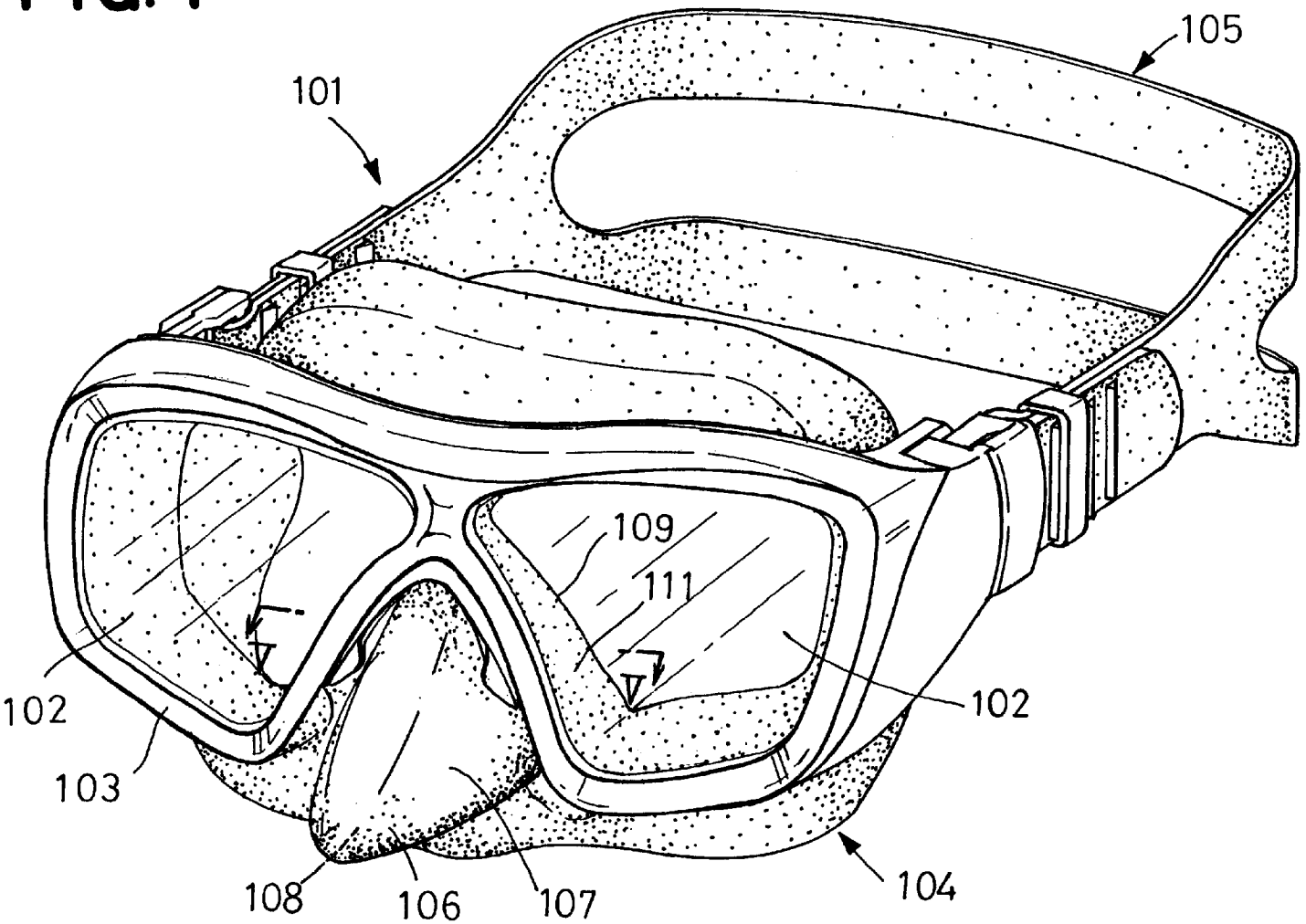
FIG. 4 is a perspective view showing face mask for diving of prior art.
Figure 5:
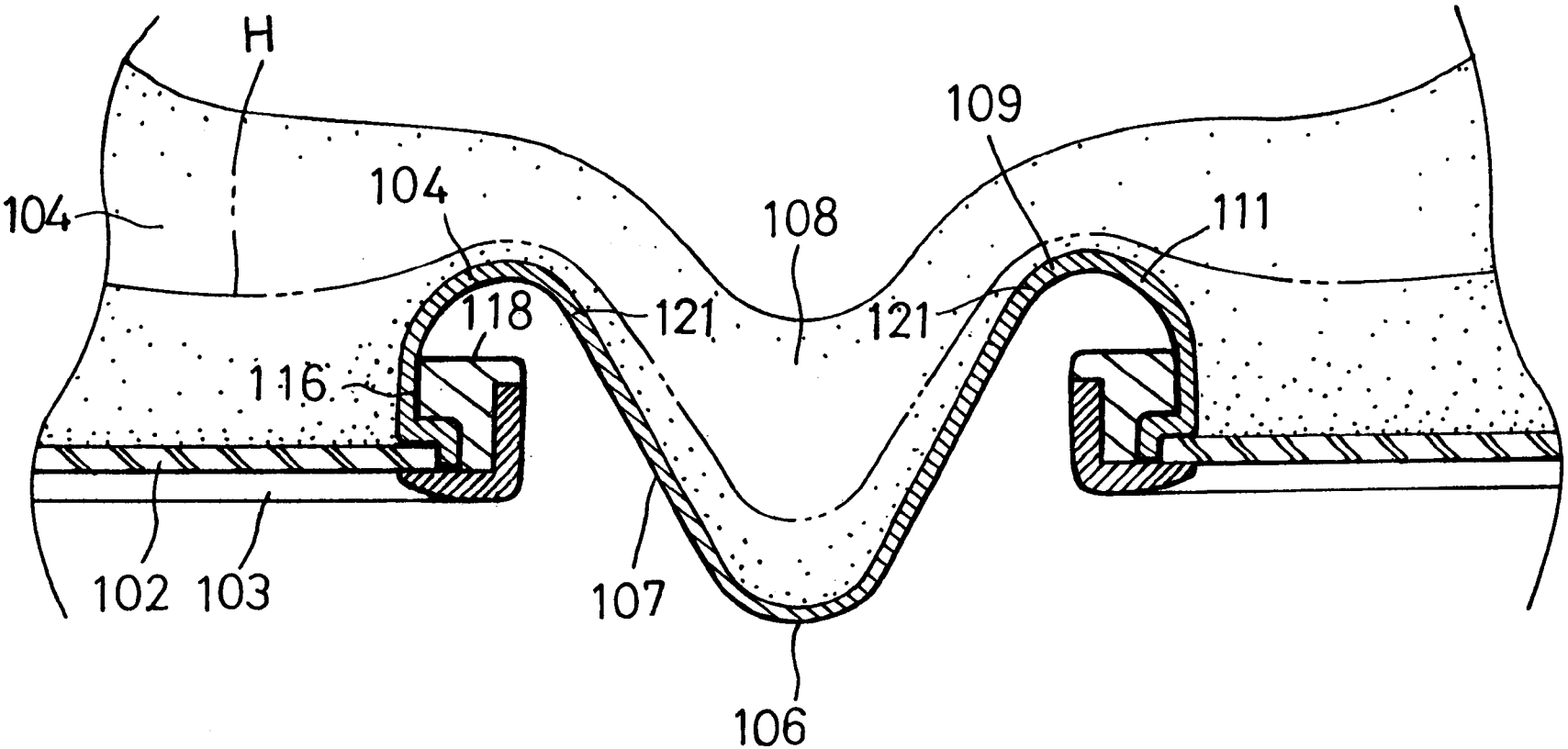
FIG. 5 is a sectional view taken along line V—V in FIG. 4.

FIGS. 2 and 3 are sectional views taken along lines II—II and III—III in FIG. 1, respectively, in which contours of the mask wearer's face are indicated by chain lines. The lens frame 3 comprises an inner frame 3A and an outer frame 3B integrally engaged with each other. Each of the annular portions 12 comprises an inner peripheral surface 16 defining an inner side of the annular portion 12, an outer surface 17 defining an outer side of the annular portion 12, an inner surface 18 confronting the mask wearer's face and an outer surface 19 opposite to the inner surface 18. The respective lenses 2 are water-tightly held together with a portion 22 of the skirt 4 lying in the vicinity of the lenses' peripheries between these inner and outer lens frame halves 3A, 3B. The skirt 4 is held between these lens frame halves 3A, 3B in the vicinity of the nose cover 6 in a manner as will be described. The side walls 7 of the nose cover 6 have their proximal ends 21 from which the portion 22 of the skirt 4 extends forwardly of the mask 1 and is continuous with respective the proximal ends 21. The portion 22 is curved along the annular portion 12 and tightly placed against the inner surface 18 as well as the inner peripheral surface 16. Additionally, these portions 22 are held between the inner and outer frame halves 3A, 3B. The proximal ends 21 and the vicinity thereof are curved along corners 23 formed with the inner surface 18 and the outer peripheral surface 17 of the frame 3 intersecting each other or in the vicinity of these corners 23 and extend forward. In other words, the nose cover 6 is configured so that the nose cover 6 project outward immediately after it extends beyond the inner surface 18 of the frame 3. The skirt 4 including such nose cover 6 has a thickness substantially without any difference between the nose cover 6 and the portion 22.

It will be apparent from the sectional view of this mask 1 taken along the line III—III (i.e., FIG. 3) that the portion of the mask 1 lying on both sides of the nose cover 6 is formed, as viewed in back-and-forth direction of the mask 1, by the lenses 2, the frame 3 and the portion 22 of the skirt 4 closely contacting one another and there is nothing obstructing fluid-communication established inside the mask 1 between the right and left lenses 2.

In the case of such mask 1, the proximal ends 21 of the nose cover 6 and the portion 22 of the skirt 4 lying in the vicinity of the proximal ends 21 may be curved along and on the frame 3 to ensure that the nose cover has a rigidity higher than that in the mask of well known construction. In this way, it is not apprehended that the nose cover 6 might be collapsed or deformed under a water pressure when the mask wearer is diving. Furthermore, the amount of water collected inside the lenses 2 can communicate between these lenses 2 through a passage defined inside the nose cover 6. In the case of the specific embodiment illustrated, it is easily possible for the diver to transfer the amount of water collected inside the lens 2 for the diver's right eye to the interior of the lens 2 for the diver's left eye merely by slightly tilting his or her head. Thereupon, the diver operate the non-return valve 11 to expel the amount of water out.

Referring to FIG. 3, a portion 23 appearing to swell slightly inwardly of the mask 1 in the vicinity of the lower end of the lens 2 is a nose holding portion formed with the skirt 4 (See FIG. 1 also).

In the face mask for diving according to this invention, the proximal ends of the nose cover formed by the skirt and the vicinity thereof have a sufficiently high rigidity to avoid an anxiety that the nose cover might be easily collapsed or deformed under a water pressure. In addition, there is nothing obstructing movement of water between the pair of front lenses and such feature facilitates the amount of water collected inside the lenses to be expelled out.

What is claimed:

1. A face mask for diving which comprises:

a lens frame having a pair of annular portions intersecting each other at an intersection point provided along upper edges thereof and extending downward from the intersection point so as to describe a substantially inverted V-shaped region;

a pair of lenses surrounded by the annular portions of the lens frame;

a skirt extending reward from peripheral portions of the pair of lenses;

a head band extending rearward from laterally opposite ends of said lens frame so as to form a loop; and a nose cover defined by a portion of the skirt that extends across the inverted V-shaped region of the lens frame, the nose cover including a pair of side walls and a bottom wall, and the lens frame having inner and outer peripheral surfaces at least inside and outside the annular portions, and an inner surface extending between the inner and outer peripheral surfaces and confronting the face of a person wearing the face mask, a portion of the skirt contiguous to respective proximal ends of the side walls of the nose cover being curved along the annular portions of the lens frame and closely in contact with the inner peripheral surface and the inner surface.

* * * * *